US010525760B1

(12) United States Patent
Ali

(10) Patent No.: US 10,525,760 B1
(45) Date of Patent: Jan. 7, 2020

(54) MARKER PEN WITH ANGULARLY ADJUSTABLE TIP

(71) Applicant: Daryl Ali, St. Charles, MO (US)

(72) Inventor: Daryl Ali, St. Charles, MO (US)

( * ) Notice: Subject to any disclaimer, the term of this patent is extended or adjusted under 35 U.S.C. 154(b) by 0 days.

(21) Appl. No.: 15/964,530

(22) Filed: Apr. 27, 2018

(51) Int. Cl.
*B43K 17/00* (2006.01)
*B43K 24/00* (2006.01)
*B43K 3/00* (2006.01)

(52) U.S. Cl.
CPC ..... *B43K 17/005* (2013.01); *B43K 3/00* (2013.01); *B43K 24/00* (2013.01)

(58) Field of Classification Search
CPC . B43K 3/00; B43K 8/025; B43K 8/04; B43K 8/06; B43K 8/08; B43K 8/12; B43K 24/00; B43M 11/06; B43M 11/08; B65D 47/42
See application file for complete search history.

(56) References Cited

U.S. PATENT DOCUMENTS 3,554,660 A * 1/1971 Woods ..... B43K 7/00 401/214
4,269,525 A 5/1981 Melikian
5,174,814 A 12/1992 Burwell et al.
7,195,415 B1 * 3/2007 Vial ..... B43K 5/005 401/109
2012/0207533 A1 * 8/2012 Liu ..... B43K 8/003 401/262
2018/0140072 A1 * 5/2018 Chen ..... A45D 34/04

FOREIGN PATENT DOCUMENTS

KR 200456338 Y1 * 10/2011 ..... B43K 8/003
WO WO-2019012348 A1 * 1/2019 ..... B43K 8/003

* cited by examiner

*Primary Examiner* — David P Angwin
*Assistant Examiner* — Bradley S Oliver
(74) *Attorney, Agent, or Firm* — Sanchelima & Associates, P.A.; Christian Sanchelima; Jesus Sanchelima

(57) ABSTRACT

A marker pen that allows a user to mark, write, or draw on hard to reach surfaces is disclosed herein. The marker pen includes an angularly displaceable tip to allow a user to mark, write or draw at various angles with respect to the body the marker pen. The angular displacement of tip is facilitated by a tip holder, which facilities the coupling between the tip and body of marker pen. The tip holder includes a first case, second case, and rotational shaft passing through concentric openings formed on first and second case. The tip is snugly fit onto a rotational shaft that allows it to be moved between a predetermined angular range.

8 Claims, 4 Drawing Sheets

MARKER PEN WITH ANGULARLY ADJUSTABLE TIP

BACKGROUND OF THE INVENTION

1. Field of the Invention

The present disclosure relates to a pen for marking on hard to reach surfaces. More particularly, the present disclosure relates to a marker pen for marking on hard to reach surfaces by angularly adjusting tip of marker pen with respect to the position of the surface.

2. Description of the Related Art

Conventionally, a technician uses a marker pen along with forceps for drawing lines, dots or indications on a surface of a component that is positioned hard to reach location, thereby causing inconvenience for the technician. Hence, there is a need for a marker pen for rendering marking at ease.

Several designs for marker pens have been designed in the past. None of them, however, disclose a marker pen with an adjustable tip which allows a user to mark/draw with relative ease on a surface of a component that is hard to reach.

Applicant believes that a related reference corresponds to U.S. Pat. No. 5,174,814 filed by DENNISON MANUFACTURING CO for a retractable marker pen and inks therefor and U.S. Pat. No. 4,269,525 filed by ROBERT B. MELIKIAN for writing instrument with retractable tip. The DENNISON AND ROBERT references disclose a marker pen with an advancing and retracting tip from a marker body. However, the marker pen disclosed by DENNISON AND ROBERT may not render ease to mark on a surface positioned at hard to reach location.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a marker pen that is adjustable to allow a user to write or draw on a surface of a component positioned at hard to reach locations with ease.

It is another object of the present invention to provide a marker pen that is adjustable to allow a user to write or draw on a surface of a component positioned at hard to reach locations without using any auxiliary instruments like forceps.

It is still another object of the present invention to provide a marker pen having a detent for selectively adjusting a tip such that the tip co-operates with a surface of a component positioned at hard to reach locations and create a mark by drawing/writing thereon without using any auxiliary instruments.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
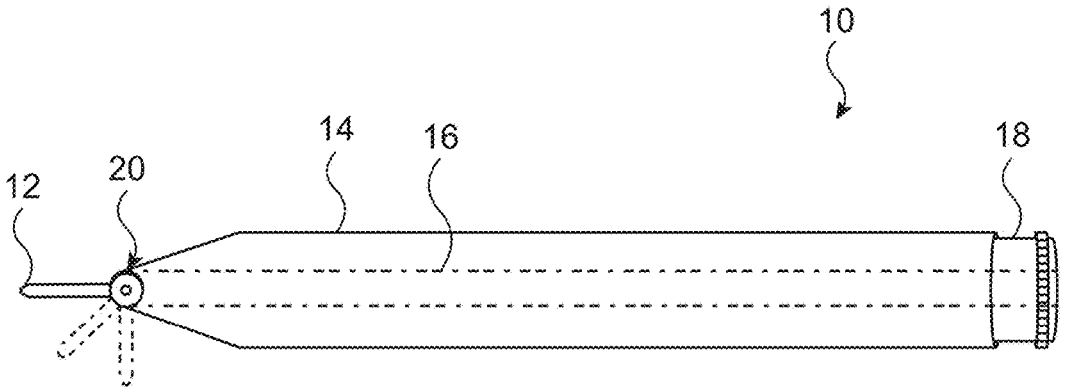
FIG. 1 represents a top view of the present invention showing a marker pen having a body and a tip extending from the body. Tip is an angularly adjustable tip with the dotted lines indicating different positions in which tip can be used.
Figure 2:
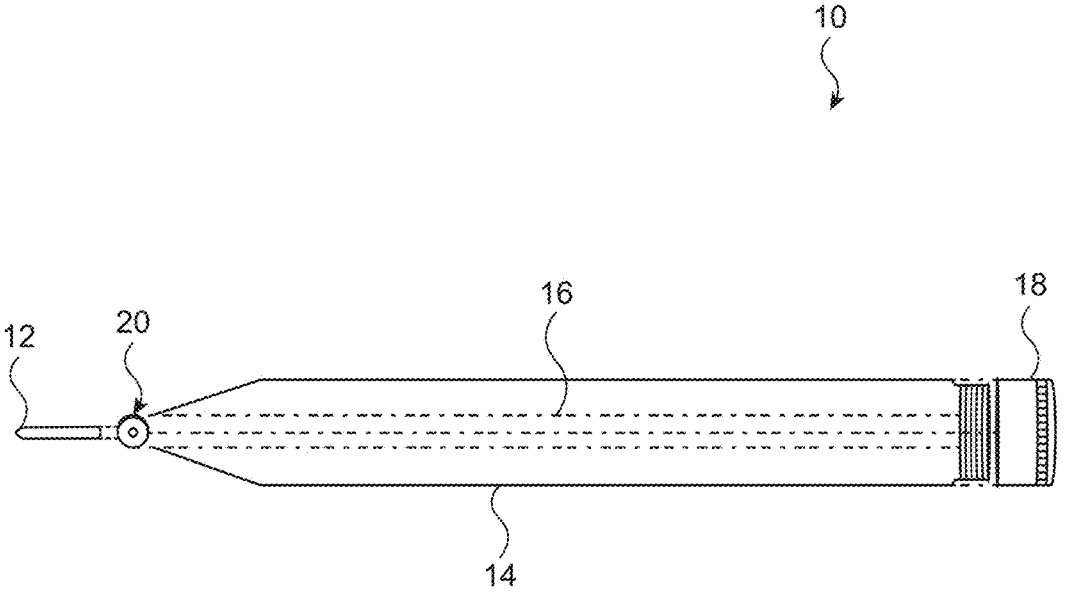
FIG. 2 demonstrates of an exploded view of marker pen 10 showing the tip or tip 12, body 14, tip holder 20 that holds the tip 12 and the body 14 in an assembled configuration, ink cartridge 16, and cover 18.
Figure 3:
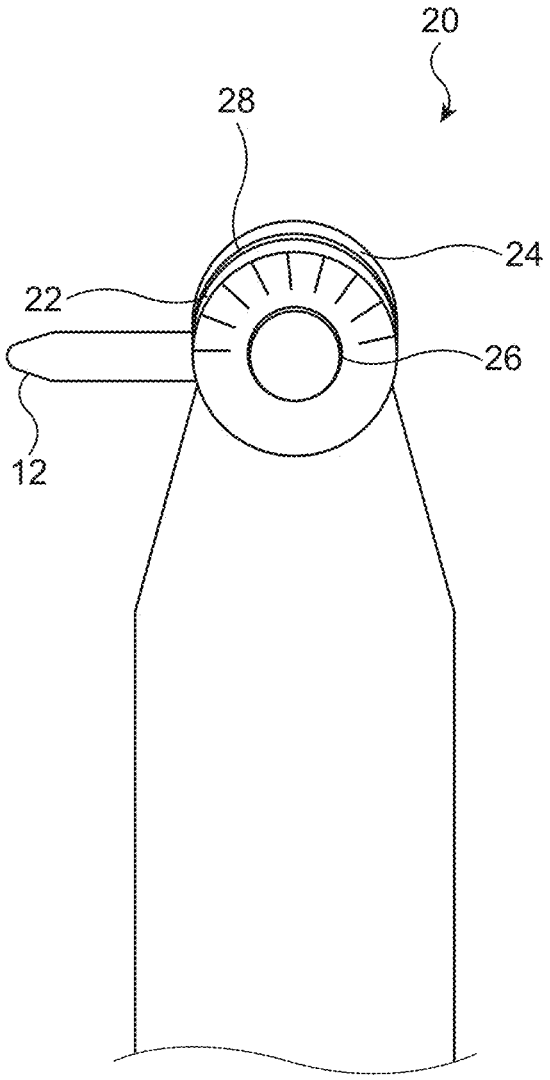
FIG. 3 shows a front view of the tip holder 20, which includes a first case 22, second case 24, and rotating shaft 26 passing through concentrically arranged first case 22 and second case 24.
Figure 4:
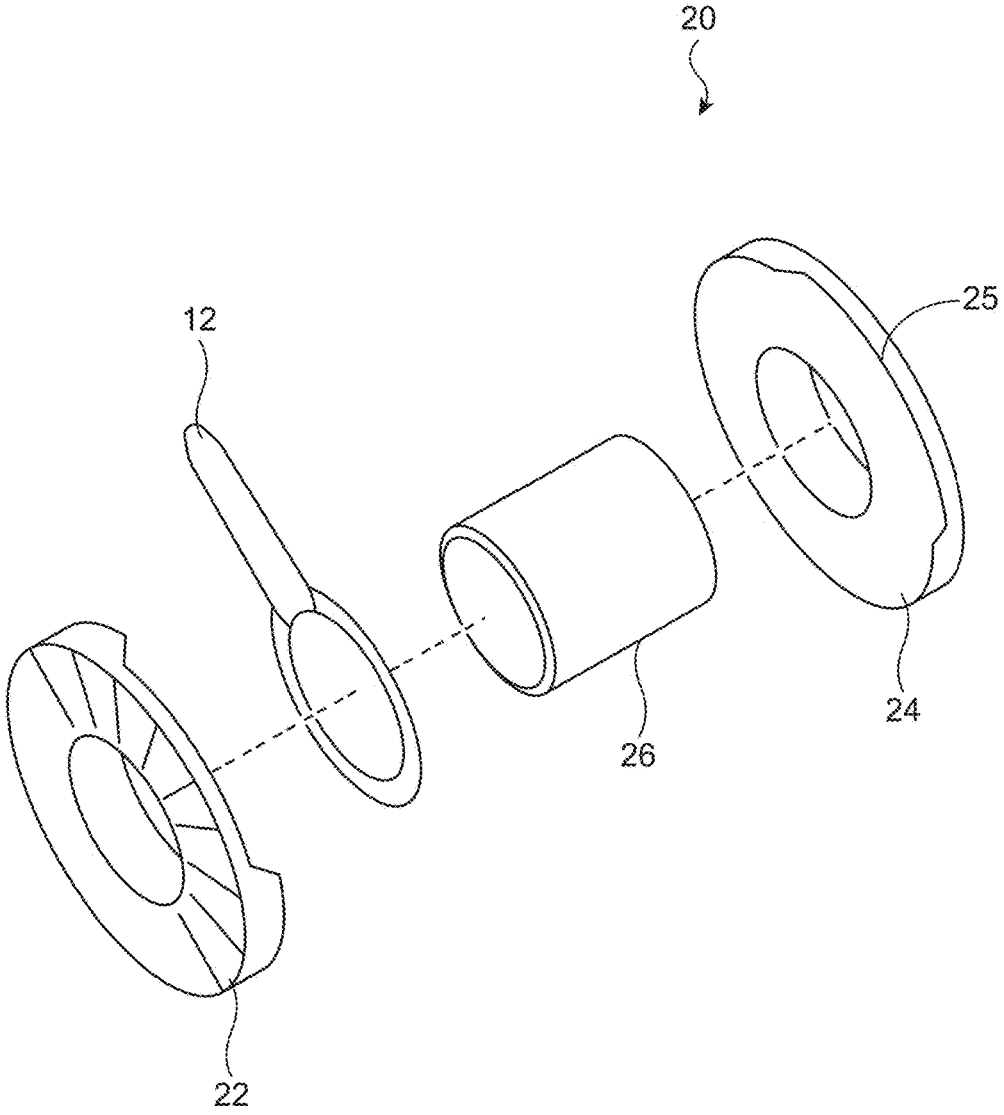
FIG. 4 is an exploded view of the tip holder 20, wherein the first case 22, second case 24, rotating shaft 26, and tip 12 are shown in the sequence they are assembled.

Referring now to the drawings, FIGS. 1-4, where the present invention is generally referred to with numeral 10, it can be observed that a marker pen, in accordance with one embodiment, is provided that includes a tip 12, a body 14 having an ink cartridge 16 such that ink from ink cartridge 16 flows to tip 12, cover 18 removably coupled with distal end of body 14, typically by thread connection, snap fit or press fit, and tip holder 20 attached to front end of body 14 for holding tip 12.

Tip 12 extends beyond body 14. Tip 12 can be a felt tip, plastic tip, ball tip, brush tips, chrome-plated tips for use in technical pens or like tips that can be held and rotated.

Tip holder 20 facilitates the coupling between tip 12 and body 14. The configuration of tip holder 20 allows tip 12 to be angularly displaceable to facilitate adjustment of tip 12 at various angles. This property of tip 12 to be angularly displaceable allows a user to mark, draw or write on a surface of a component positioned at hard to reach location, for example marking/scribbling a line under a stringer or a stiffener of an aircraft structure. Also, the angular displacement of the tip 12 obviates the need of using forceps, as was the case with the conventional markers, where a user had to use the conventional marker in conjunction with forceps to mark, write or draw at hard to reach locations on the surface of a component.

Tip holder 20 comprises a first case 22, second case 24, and rotational shaft 26. In an assembled configuration of tip holder 20, tip 12 is snugly fit over the rotational shaft 26, and the rotational shaft 26 passes through concentric openings formed on first case 22 and second case 24.

In an assembled configuration of tip holder 20, rotational shaft 26 passes through first case 22 and second case 24. In one embodiment, the first case 22 is provided with an angular scale configured on an external surface thereof. The angular scale allows the user to orient tip 12, via rotational shaft 26, as per application requirements. More specifically, in order to tilt tip 12, the user holds and rotates the protruding portion of the rotational shaft 26 that protrudes beyond the first case 22.

In the assembled configuration of the tip holder 20, a gap 28 is formed between first case 22 and the second case 24, within which the tip 12 is displaceable. The gap 28 is formed because of trough formation 25 formed on first case 22 and second case 24, and a similar trough formation formed on first case 22 as well. The complementary nature of the trough formations results in the formation of gap 28 between first case 22 and second case 24. It is within this gap 28 that tip 12 is angularly displaceable. The thickness of the gap 28 is such that tip 12 snugly fits into the gap 28, in which case gap 28 itself acts as detent for holding tip 12 in a specific position. Other embodiments where detent is achieved by other means, e.g., snap formations, gear arrangements, and the like mechanisms that can selectively angularly adjust tip 12 and rigidly hold tip 12 are well within the ambit of the present disclosure.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed:

1. A marker pen, comprising:

A body having a tapered end leading to a distal end, said distal end includes a tip holder, an ink cartridge housed entirely inside said body and in fluid connection with said tip holder, a tip mounted to and extending from said tip holder, said tip holder includes a first ring-like casing, a second ring-like casing having substantially the same diameter of said first ring-like casing, a rotating shaft mounted between said first and second ring-like casing, said first and second ring-like casings each including concentric openings, said rotating shaft mounted to said first and second ring-like casing using said concentric openings, said tip includes in a tip ring portion and a tip portion extending therefrom, said tip ring portion is mounted between said rotating shaft and said first ring-like casing, said tip adapted to rotate with said rotating shaft to define an angle for a user to write with using said tip, a locking mechanism for locking said tip at a predetermined angle.

2. The marker pen of claim 1 wherein said tip holder is round.

3. The marker pen of claim 1 wherein said body is hollow and substantially tubular.

4. The marker pen of claim 1 having a proximal end opposite said distal end, said proximal end includes an opening adapted to allow a user to remove and install said ink cartridge, a cap covering said opening.

5. The marker pen of claim 1 wherein said tip is a long tip adapted to permit a user to draw or write in hard to reach areas.

6. The marker pen of claim 1 wherein said tip ring portion is snugly fit over said rotating shaft.

7. The marker pen of claim 1 wherein said first ring-like casing includes a gap of a dimension that cooperates with said tip being nestled therein, said gap extends a predetermined distance that correlates with the angular range the tip shifts between.

8. The marker pen of claim 7 wherein gap is a detent, said tip has a base between said tip ring portion and said tip, said base comes into abutting engagement with said rotating shaft and said detent thereby creating a predetermined amount of friction used to lock said tip at said predetermined angle.

* * * * *